US005555710A

United States Patent [19]

Smith

[11] Patent Number: 5,555,710

[45] **Date of Patent: * Sep. 17, 1996**

[54] INFLATABLE SADDLE SUPPORT APPARATUS

[76] Inventor: Scott C. Smith, Rt. 2 Box 370-A, Marshall, Tex. 75670

[ * ] Notice: The term of this patent shall not extend beyond the expiration date of Pat. No. 5,548,948.

[21] Appl. No.: 322,416

[22] Filed: Oct. 13, 1994

Related U.S. Application Data

[63] Continuation-in-part of Ser. No. 283,205, Jul. 28, 1994.

[51] Int. Cl.[6] ..... B68C 1/12; B68C 1/08

[52] U.S. Cl. ..... 54/66; 54/44.6

[58] Field of Search ..... 54/44.6, 65, 66

[56] References Cited

U.S. PATENT DOCUMENTS 481,289 8/1892 Underwood ..... 54/66

3,971,194 7/1976 Morgan ..... 54/66

*Primary Examiner*—Robert P. Swiatek

*Attorney, Agent, or Firm*—John M. Harrison

[57] ABSTRACT

An inflatable saddle support apparatus which is characterized in a first preferred embodiment by an inflatable saddle bladder that fits beneath a saddle blanket on a horse and serves to equalize the pressure applied by a saddle and rider to a horse. The inflated saddle bladder is shaped to effectively fill the voids between the saddle and the horse and one or more felt or alternative pads may be positioned on the inflation chamber or chambers of the saddle bladder or on the saddle blanket to dissipate heat and optionally, to form pockets, and the saddle bladder may be positioned in the pockets. Alternatively, the saddle bladder, with or without felt pads, may be slipped inside a pair of fleece pockets attached to the saddle blanket. The saddle blanket and saddle bladder, with or without the felt pads and fleece panels, are then placed on a horse to receive a saddle. The saddle bladder may be inflated without dismounting by introducing air into an inflation tube which communicates with the inflation chambers of the saddle bladder to provide a selected degree of pressure equalization between the saddle and rider and the horse.

16 Claims, 1 Drawing Sheet

INFLATABLE SADDLE SUPPORT APPARATUS

CROSS-REFERENCE TO RELATED APPLICATIONS

This application is a Continuation-In-Part of our copending application Ser. No. 08/283,205, filed Jul. 28, 1994.

BACKGROUND OF THE INVENTION

1. Field of the Invention

This invention relates to saddle pads for horses and more particularly, to an inflatable support apparatus which fits between the saddle and a horse to effectively fill the "hollow spots", gaps, or voids between the saddle and horse and efficiently disperse and distribute the weight of the rider and the saddle throughout the bearing surface of the saddle. The inflatable saddle support apparatus is characterized in a first preferred embodiment by a selectively inflatable, sealed, single or dual inflation chamber saddle bladder which may be positioned directly between the horse and saddle. However, in a most preferred embodiment of the invention the saddle bladder is more particularly located in a pair of felt or fleece pockets fastened to the saddle blanket, with or without felt pads, which saddle blanket and contained saddle bladder is then placed on a horse and receives the saddle. The saddle bladder can be inflated by the rider without the necessity of dismounting, by pressurizing an inflation tube communicating with the single or dual inflation chambers of the sealed saddle bladder, to effect the desired degree of pressure equalization between the saddle and the horse.

2. Description of the Prior Art

The fitting of a saddle to a horse has, at best, been an indefinite and inexact practice over a long period of time. Since various types of saddles are manufactured with multiple types and shapes of supporting saddle trees and padding and since horses are of varying size and shape, the saddles many times fit very poorly on the animals. The degree of fit can be determined by sweat marks which show superficial areas of improper fit, but these sweat marks do not reveal the amount of pressure applied by the saddle tree, saddle and rider to the horse. An early attempt to rectify this problem included the use of blankets which were used to protect the sheepskin or leather lining on the underside of the saddle. The effort was designed to at least partially fill in the inverted "V" characterized by the saddle tree, wherein the widest part of the saddle tree rests on the horse. Downwardly-extending sides of the saddle tree become the weight-bearing surfaces of the tree, while the narrower top keeps pressure from the sensitive withers and spinal area of the horse.

Problems with saddle fit may originate from several sources: first of all, the saddle tree itself and the quality of the saddle tree construction are primary factors. A poorly constructed saddle tree is usually found in very low-line saddles and very seldom adequately fits any horse's body. Furthermore, a saddle can be damaged and the tree even broken, for example, in western saddles or shifted stuffing can be the problem in English saddles. If the saddle fits and is relative comfortable on the horse, then the next consideration is the amount and type of padding which may be used to increase the comfort of the horse during riding. Various types and shapes of pads have been developed over the years for this purpose. An "ULTRASOFT" trademark) gel saddle pad is advertised in the June 1994 issue of "Western Horseman" and includes a saddle pad which is filled with a gel material and is said to be covered by U.S. Pat. No. 5,252,373. U.S. Pat. No. 226,239, dated Apr. 6, 1880, to H. C. Marsh, details an "Air-Pad For Harness" which includes a generally rectangularly-shaped, inflatable pad that fits beneath the saddle tree of a saddle for padding the saddle against the horse. U.S. Pat. No. 532,419, dated Jan. 8, 1895, to J. B. Haines, Jr., details a "Riding Saddle" which is pneumatically inflated to pad the horse. A "Harness Pad" is detailed in U.S. Pat. No. 539,709, dated May 21, 1895, to J. T. Short. The harness pad is provided with an inflatable bladder and a valve for inflation purposes, to pad the horse while the horse is pulling loads. U.S. Pat. No. 550,380, dated Nov. 26, 1895, to E. Plumhoff, details a "Pneumatic Gig Pad". The gig pad is provided with inflatable bladders for inflation to a specified pressure to pad the horse. A "Saddle Pad For Harness" is detailed in U.S. Pat. No. 578,575, dated Mar. 9, 1897, to W. Mathis. The saddle pad is fitted with multiple inflatable tubes for padding the horse while the horse is pulling loads. U.S. Pat. No. 709,930, dated Sep. 30, 1902, to H. R. Rensman, details a "Pneumatic Saddle Pad" which fits between the saddle and the horse and includes an inflatable, tube-like member for cushioning the saddle against the horse. U.S. Pat. No. 852,593, dated May 7, 1907, to R. J. Benbo, details a saddle cushion fitted with multiple, concentric, inflatable tubes for cushioning the saddle against the horse. U.S. Pat. No. 910,689, dated Jan. 26, 1909, to J. M. Kelly, et al, details a "Pneumatic Pad for Harness", which includes an S-shaped, inflatable bladder for fitting beneath the saddle and padding the saddle against the horse. A "Saddle-Cushion Assembly" is detailed in U.S. Pat. No. 3,343,338, dated Sep. 26, 1967, to W. J. K. Stubben. The cushion includes a pair of inflatable bladders fitted over the withers of a horse beneath the saddle, to pad the saddle against the horse. A "Riding Saddle" is detailed in U.S. Pat. No. 4,033,097, dated Jul. 5, 1977, to Michael Petit. The saddle has a seat formed by two inflatable cushions disposed on each side of the medium plane of the saddle. A pommel constituted by an upwardly-projecting, inflatable, curved element is assembled with the front edge of the cushions. An inflatable cantle is also assembled with the rear edge of the seat. U.K. Patent No. 2,090,512, dated Jul. 14, 1982, to H. C. Schaupp, details "Saddle Numnahs" for placing on a horse's back beneath the saddle. The devices include an air cushion inserted in a pocket in a main body portion of each numnah. The air cushion has a mouth-inflatable valve and is bonded around its edge and along bond lines which divided into multiple air compartments intercommunicating by means of gaps in the bond lines. German Patent No. 2428852 details a device designed to protect a horse from injury and includes a pneumatic tube fitted with valves in the form of a cushion which, when inflated, is arch-shaped to fit over the back of the horse under the saddle to pad the saddle against the horse. These devices have a common goal of padding the saddle, with no particular regard or concern for filling the voids or gaps between the horse and the saddle.

The prior art devices have each been designed to facilitate a uniform cushioning thickness on a horses back. In contrast, the inflatable saddle support of this invention is non-uniform in thickness, operating to self-adjust and fill the various voids between the saddle tree or padding of various saddles or horses of various size. The device operates to more evenly distribute the pressure of the saddle and rider on the horses back by insuring that this pressure is distributed over the entire area of the saddle tree or saddle padding.

It is an object of this invention to provide a new and improved inflatable saddle support apparatus which is designed to fill the voids existing between the saddle tree or padding of a saddle and a horse and more evenly distribute the pressure of the saddle against the horse.

Another object of this invention is to provide an inflatable saddle support apparatus which is characterized by a shaped, single or dual inflation chamber saddle bladder which is inflatable by means of a connecting inflation tube and is designed to fill the voids between the saddle and a horse, to distribute the pressure of a rider and saddle on a horse in a more optimum manner.

Still another object of this invention is to provide an inflatable saddle support apparatus which compensates for the difference in size and shape of a horse and is characterized by a sealed saddle bladder fitted with a pair of interconnected, spaced-apart, shaped inflation chambers that are simultaneously inflatable by means of a connecting inflation tube and are designed to receive one or more felt pads also attached to a saddle blanket which covers the saddle bladder, to fill the gap or voids between the saddle tree or pad and the horse, and better distribute the weight of the rider and saddle on the horse.

A still further object of this invention to provide an inflatable saddle support apparatus which includes a saddle bladder having a single inflation chamber or a pair of interconnected, spaced-apart inflation chambers, with a flat, non-inflatable area or an elongated opening between the inflation chambers to reduce pressure on a horses's spine. Further included is an inflation tube for inflating the inflation chambers, in order to fill the gaps or voids between the saddle tree or padding and the horse and distribute the pressure of a rider and saddle on the horse in an optimum manner. In a most preferred embodiment one side of the saddle bladder is glued, sewn or removably connected to a pair of felt pads and is sandwiched between the felt pads and a saddle blanket in a pair of fleece pockets attached to the felt pads, to support a saddle.

SUMMARY OF THE INVENTION

These and other objects of the invention are provided in an inflatable saddle support apparatus which is characterized in its simplest form by an inflatable saddle bladder positioned on a horse beneath a saddle blanket. In another embodiment one surface of the saddle bladder may be sewn, glued, or removably attached by means of loop-pile fasteners or the like, to a single felt pad or a pair of felt pads, which pads are, with the inflatable saddle bladder, placed beneath the saddle blanket and the apparatus positioned on a horse. Alternatively, the inflatable saddle bladder, with or without the felt pad or pads, may be enclosed in one or more fleece or felt pockets sewn and attached by means of loop-pile fasteners to the saddle blanket. The saddle bladder is characterized by one or a pair of spaced-apart but interconnected inflation chambers and an inflation tube, which inflation chambers border a flat, non-inflatable area or an elongated slot or opening lying adjacent the horses' spine. These elements facilitate inflating the inflation chambers to a desired extent by a rider without dismounting, and filling the voids and gaps between the saddle tree or saddle padding and the horse, to more evenly distribute the pressure of a rider and saddle on the animal and protect the spinal area.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4, 5, 6, 7, 8, 9:
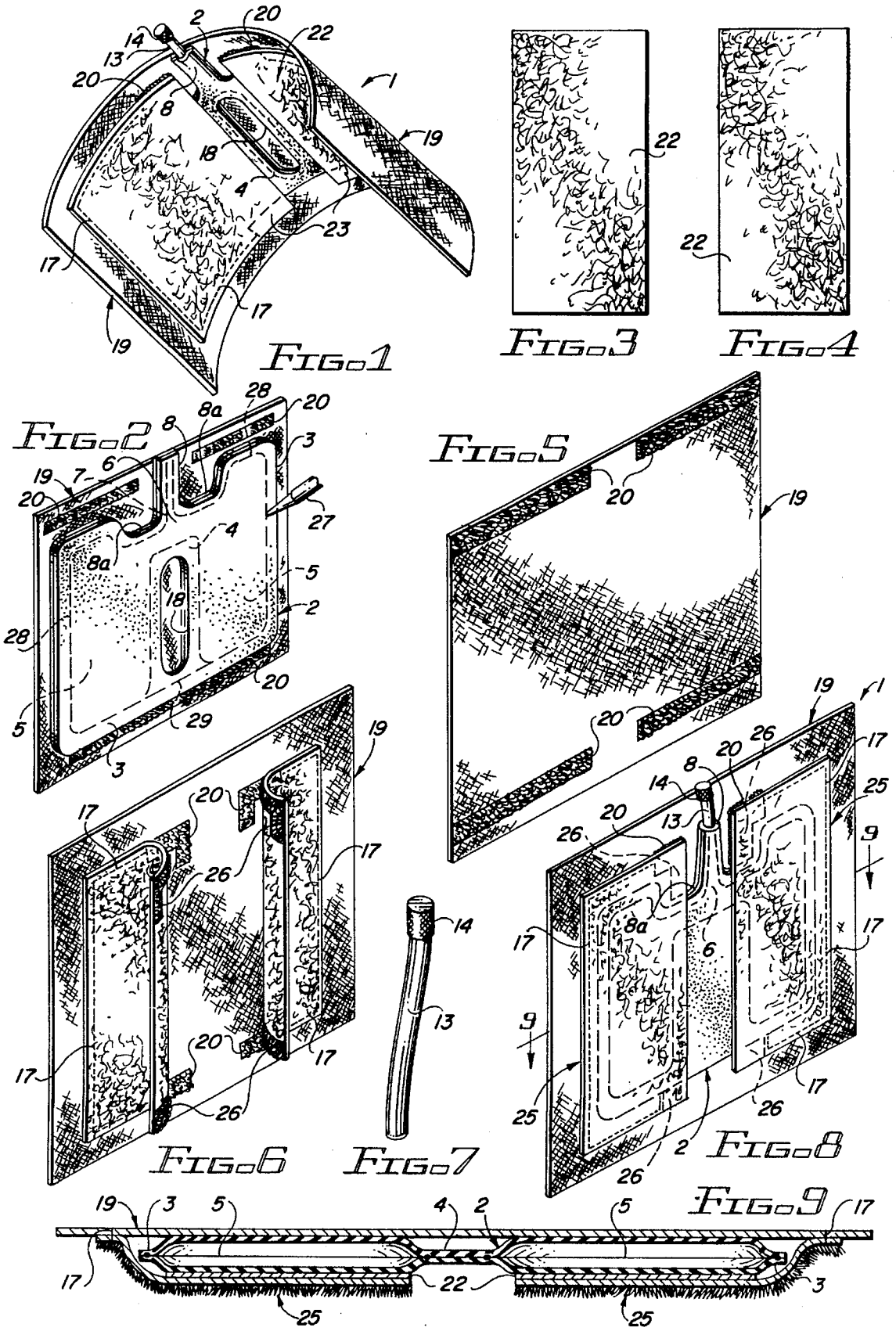
FIG. 1 is a perspective view of a preferred embodiment of the inflatable saddle support apparatus of this invention in non-inflated configuration.
FIG. 2 is a perspective view of a modified inflatable bladder element and saddle blanket of the inflatable saddle support apparatus illustrated in FIG. 1.
FIG. 3 is a top view of a felt pad or panel element of the inflatable saddle support apparatus illustrated in FIG. 1.
FIG. 4 is a bottom view of the felt pad or panel, more particularly illustrating loop elements for removably securing the felt pad or panel on a saddle blanket.
FIG. 5 is a perspective view of the saddle blanket element of the inflatable saddle support apparatus illustrated in FIG. 1.
FIG. 6 is a perspective view of the saddle blanket illustrated in FIG. 5, with a pair of fleece pockets or panels attached thereto to removably receive the inflatable saddle bladder.
FIG. 7 is a perspective view of an inflation tube element of the inflatable air bladder.
FIG. 8 is a composite view of the inflatable saddle bladder inserted in the fleece pockets or panels attached to the saddle blanket in functional configuration and ready for mounting on a horse and receiving a saddle.
FIG. 9 is a sectional view of an alternative inflatable saddle support apparatus composite, illustrating felt pads added to the inflatable saddle bladder, with both the felt pads and the inflatable saddle bladder removably inserted in fleece pockets.

Referring initially to FIGS. 1–5 and 7 of the drawing, in a preferred embodiment, the inflatable saddle support apparatus of this invention is generally illustrated by reference numeral 1. The inflatable saddle support apparatus 1 is characterized by an inflatable saddle bladder 2, which is glued or otherwise sealed at a sealed bladder edge 3 by means of a continuous sonic weld 28, using a sonic weld tip 27, and a bladder seal 4 and elongated opening 18 located in the center thereof, to define a pair of inflation chambers 5. Alternatively, a single inflation chamber 5 can be provided in the saddle bladder 2 by incorporating an alternate sonic weld 29 and eliminating the bladder seal 4 and opening 18, as further illustrated in FIG. 2. The elongated opening or slot 18 at the bladder seal 4 between the inflation chambers 5 is provided for purposes which will be hereinafter further described. An inflation tube 13, illustrated in FIG. 7, is sealed in the inflation neck 8 of the saddle bladder 2 at the upper end of the bladder seal 4 and opening 18 and one end of the inflation tube 13 communicates with the inflation chamber or chambers 5 at the connecting inflation chamber 6, while the other end of the inflation tube 13 receives an inflation tube cap 14, as illustrated. The inflation tube 13 can be fitted with a valve stem (not illustrated) for attachment to an air pump (not illustrated) or a rubber bulb (not illustrated) to inflate the inflation chamber or chambers 5, or air can be forced directly into the inflation tube 13 and inflation chamber or chambers 5 by mouth, as desired. Any of these techniques may be used to facilitate quickly, easily and selectively inflating and deflating the primary inflation chamber or chambers 5.

As further illustrated in FIGS. 1 and 2, in a most preferred embodiment of the invention the inflation chambers 5 are sealed with respect to each other at the bladder seal 4, but are interconnected by the connecting inflation chamber 6, such that inflation of the connecting inflation chamber 6 by air introduced into the inflation tube 13 also inflates the inflation chambers 5. This expedient facilitates inflation of the inflation chambers 5 beneath a saddle (not illustrated), in order to insure that the voids beneath the saddle are fully filled and the weight of the rider and saddle are distributed over the entire area of the saddle tree or saddle padding. The flat bladder seal 4, with an opening 18, further insures that no pressure is applied to the horse's spine. As further illustrated in FIG. 2, a saddle blanket 19 is attached to the saddle bladder 2 by means of saddle blanket pile elements 20 and loop elements (not illustrated) on the saddle bladder 2. Referring now to FIGS. 1–4, in a preferred embodiment a pair of felt pads or panels 22 are sewn along stitching 17 or glued or otherwise attached to the saddle bladder 2 to serve as heat-dissipating elements. Alternatively, the felt pad or panels 22 may be glued along the facing edges to the saddle bladder 2 or provided with felt pad loop elements 23 on facing edges, and are sewn along opposite edges to a saddle blanket 19. The felt pad loop elements 23 engage corresponding saddle blanket pile elements 20 to removably enclose the saddle bladder 2 in pockets created by the felt pads or panels 22 and saddle blanket 19.

Referring now to FIGS. 5–8 of the drawing, in another preferred embodiment of the invention, the inflatable saddle support apparatus 1 includes the saddle bladder 2 fitted inside a pair of fleece panels 25, each of the latter having a long edge and part of opposite short edges attached to the saddle blanket 19 by means of stitching 17, as in the case of the felt pads or panels 22, illustrated in FIG. 1. The fleece panels 25 are fitted with fleece panel loop elements 26 and, as described above, the saddle pile elements 20 are sewn on the saddle blanket 19, and are secured to the fleece panel loop elements 26 provided on the fleece panels 25, in order to sandwich the saddle bladder 2 between the saddle blanket 19 and the two fleece panels 25, as further illustrated in FIGS. 5, 6 and 8. In both cases illustrated in FIGS. 1 and 8, the L-shaped saddle blanket pile elements 20, felt pad loop elements 23 and fleece panel loop elements 26 are positioned at the neck curves **8*a* in the saddle bladder 2 to better stabilize the saddle bladder 2** in the respective pockets.

In yet another preferred embodiment of the invention, as illustrated in FIG. 9, felt pads or panels 22 may be sewn, glued or otherwise attached to the saddle bladder 2 as illustrated in FIG. 1, such that the saddle bladder 2 and the felt pads or panels 22 are a composite. This composite may be used alone under the saddle blanket 19 or fitted between the folds or panels of the fleece panels 25 and the saddle blanket 19, with the fleece panel loop elements 26 engaging the saddle blanket pile elements 20, as described above. When the inflatable saddle bladder 2 and the felt pads or panels 22 are thusly sandwiched between the fleece panels 25 and the saddle blanket 19 as illustrated in FIG. 9, the inflation tube 13 is projected beneath the pommel or saddle horn of a saddle (not illustrated) and used to facilitate inflation or deflation of the saddle bladder 2, as desired, in order to compensate for the weight of the rider and the saddle on the horse. In the case of dual inflation chambers 5 in the saddle bladder 2, the bladder seal 4 and opening 18 prevents inflation of the middle portion of the saddle bladder 2 on the spinal area of the horse's back, where no inflation is necessary. The inflation of the inflation chambers 5 thus scales the inflation from a no inflation condition at the sealed bladder loop 4 and opening 18, throughout the inflation chambers 5, to protect the horse from the pommel-to-cantle portions of the saddle. Adjustment of the volume of air in the inflation chambers 5 is effected by introducing air into the inflation tube 13 to maintain a comfortable and optimum distribution of pressure on the horses back.

In use, and referring again to FIGS. 1–4, 8 and 9 of the drawing, the saddle bladder 2 of the inflatable saddle support apparatus 1 may be sandwiched between a pair of felt pads or panels 22, which are sewn, glued or otherwise attached to the saddle bladder, or positioned between the fleece panels 25, as desired, and a saddle blanket 19 as described above and the resulting assembly is initially placed directly on a horse's back above the withers and over the shoulder blades, extending rearwardly toward the flank area. A saddle is then placed directly over the saddle blanket 19, with the front edge of the saddle resting several inches behind the front edge of the saddle blanket 19 and the inflation tube 13 projecting from beneath the saddle blanket 19, at the saddle ponnel (not illustrated). The inflation chamber or chambers 5 of the saddle bladder 2 should be fully or partially deflated when saddling. The saddle is then secured in the normal manner for proper and safe use. After the saddle is secured on the horse, air is introduced into the inflation chambers 5 through the inflation tube 13 by blowing into the inflation tube 13 or by use of pump or bulb (not illustrated) as desired. Sufficient air should be added to the inflation chamber or chambers 5 to facilitate expansion of the inflation chamber or chambers 5 into the areas of least resistance, or the so-called "hollow spots", gaps or voids between the saddle and the saddle bladder 2. The inflatable saddle support apparatus thus facilitates optimum distribution of pressure between the saddle and the horse.

In another preferred embodiment of the invention, under circumstances where the inflatable saddle support apparatus 1 is characterized by the saddle bladder 2, felt pads or panels 22 and the fleece panels 25, the saddle bladder 2 and felt pads or panels 22 are positioned in pockets defined by the fleece panels 25 and the assembly is then placed on a horse.

It is expedient in all cases to secure the respective elements of the inflatable saddle support apparatus 1 together as described above, both to serve as more efficient support of the saddle on the horse's back and to facilitate minimum movement of the saddle bladder 2 of the inflatable saddle support apparatus 1 with respect to the horse during riding. When the inflation tube cap 14 is removed from the inflation tube 13, air can be introduced in a selected volume into the inflation tube 13 by any desired mode to provide sufficient pressure in the inflation chamber or chambers 5 of the saddle bladder 2 and facilitate resting of the saddle on the horse's back as it was designed, thus forming a uniform and optimum support area for weight distribution, regardless of the size and shape of the horse. Accordingly, the inflatable saddle support apparatus 1, in each of the variations described herein, serves to correct saddle imperfections, bridge gaps and promote pressure distribution where the saddle tree or saddle pad is not meeting the horse's back and thus, helps disperse areas of excessive pressure, while not elevating the saddle tree from areas of the horse's back which are normally contacted.

It is understood that the saddle bladder 2 can be used as described above with only the saddle blanket 19, as illustrated in FIG. 2, and with either or both of the felt pads or panels 22 (FIG. 1) and the fleece panels 25, in combination with the saddle blanket 19 (FIG. 8), as desired. However, a most preferred design for the inflatable saddle support apparatus is one or more, either fleece or felt pads or panel pockets, attached to the saddle bladder 2 together with a removable saddle blanket 19 to protect and stabilize the saddle bladder 2 in the correct position and location on a horse. Furthermore, the size of the saddle bladder 2 and/or the saddle blanket 19 can be altered to accommodate an English saddle, exercise saddle, western saddle and other styles of saddles, as desired. Moreover, any desired type of material can be used to sandwich the saddle bladder 2 in the manner described above.

It will be appreciated by those skilled in the art that in all of the embodiments of the invention described above, the saddle bladder 2 element of the inflatable saddle support apparatus 1 may be constructed of various rubber compositions or vinyl plastic and constructed in one piece or sealed by glue, sonic welds 28 using the sonic weld tip 27, illustrated in FIG. 2, or the like, according to the knowledge of those skilled in the art. Furthermore, the felt pads or panels 22 can be shaped from conventional felt or alternative material of desired thickness, with the felt pad slot loop elements 23 configured to match the saddle blanket pile elements 20 on the saddle blanket 19. In like manner, the saddle blanket 19 must be sufficiently large to facilitate covering the felt pads or panels 22 and the saddle bladder 2.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An inflatable saddle support apparatus for evenly distributing the pressure of a saddle on a horse, comprising a saddle bladder; at least one inflation chamber provided in said saddle bladder and an inflation tube communicating with said at least one inflation chamber for selectively inflating said at least one inflation chamber; a saddle blanket sized to fit over said saddle bladder, said saddle blanket connected to said saddle bladder, for seating on the horse; and a pair of panels, each of said panels having at least one edge attached to said saddle blanket and comprising at least one first element of a loop-pile fastener attached to said saddle blanket and at least one second element of said loop-pile fasterner attached to each of said panels, for removably enclosing said saddle bladder between said saddle blanket and said panels, responsive to engagement of said first and second elements of said loop-pile fastener.

2. The inflatable saddle support apparatus of claim 1 wherein said at least one inflation chamber comprises a pair of inflation chambers and wherein said inflation chambers are separated by a sealed, uninflatable area corresponding to the spinal area of the horse when said inflatable saddle support apparatus is positioned on the horse.

3. The inflatable saddle support apparatus of claim 2 comprising a connecting inflation chamber communicating with said inflation tube and said inflation chambers in said saddle bladder.

4. The inflatable saddle support apparatus of claim 1 comprising at least one felt pad attached to said saddle bladder at said at least one inflation chamber and wherein said pair of panels comprises a pair of fleece panels for removably enclosing said inflatable bladder and said at least one felt pad between said saddle blanket and said fleece panels, responsive to engagement of said first and second elements of said loop-pile fastener.

5. The inflatable saddle support apparatus of claim 4 wherein said at least one inflation chamber comprises a pair of inflation chambers and wherein said inflation chambers are separated by a sealed, uninflatable area corresponding to the spinal area of the horse when said inflatable saddle support apparatus is positioned on the horse.

6. The inflatable saddle support apparatus of claim 4 comprising a connecting inflation chamber communicating with said inflation tube and said inflation chambers in said saddle bladder.

7. The inflatable saddle support apparatus of claim 1 wherein said at least one inflation chamber comprises a single inflation chamber.

8. An inflatable saddle support apparatus for positioning between a saddle and a horse and filling voids between the saddle and the horse when said inflatable saddle support apparatus is inflated, said inflatable saddle support apparatus comprising an inflatable saddle bladder; a pair of inflation chambers provided in said saddle bladder; a sealed, uninflatable area provided in said saddle bladder, said sealed, uninflatable area extending between said inflation chambers; a connecting inflation chamber provided in said saddle bladder, said connecting inflation chamber communicating with said inflation chambers; an inflation tube provided in said saddle bladder, said inflation tube communicating with said connecting inflation chamber, whereby air is selectively introduced into and released from said connecting inflation chamber and said inflation chambers through said inflation tube; a saddle blanket sized to fit over said saddle bladder; and pad means provided on said inflation chambers for stabilizing said saddle bladder with respect to said saddle blanket when said inflatable saddle support apparatus is placed on a horse.

9. The inflatable saddle support apparatus of claim 8 wherein said pad means comprises a pair of felt pads, each of said felt pads having at least one edge attached to said saddle blanket and comprising first and second attachment means provided on said felt pads and said saddle blanket, respectively, said first attachment means on said felt pads engaging said second attachment means on said saddle blanket and removably securing said inflatable bladder between said felt pads and said saddle blanket.

10. The inflatable saddle support apparatus of claim 8 wherein said pad means comprises a pair of fleece pads, each of said fleece pads having at least one edge attached to said saddle blanket and comprising at least one first element of a loop-pile fastener attached to said saddle blanket and at least one second element of said loop-pile fastener connected to each of said fleece pads for removably enclosing said saddle bladder between said saddle blanket and said fleece pads, responsive to engagement of said at least one first and second elements of said loop-pile fastener.

11. The inflatable saddle support apparatus of claim 8 wherein said pad means comprises a pair of felt pads covering said inflation chambers on said saddle bladder.

12. The inflatable saddle support apparatus of claim 11 wherein said pad means comprises a pair of felt panels, each of said felt panels having at least one edge attached to said saddle blanket and comprising first and second attachment means provided on said felt panels and said saddle blanket, respectively, said first attachment means on said felt panels engaging said second attachment means on said saddle blanket and removably securing said inflatable bladder and said felt pads between said felt panels and said saddle blanket and comprising first and second attachment means provided on said felt panels and said saddle blanket, respectively, said first attachment means on said felt panels engaging said second attachment means on said saddle blanket and removably securing said inflatable bladder and said felt pads between said felt panels and said saddle blanket.

13. The inflatable saddle support apparatus of claim 11 wherein said pocket means comprises a pair of fleece panels, each of said fleece panels having at least one edge attached to said saddle blanket and comprising at least one first element of a loop-pile fastener attached to said saddle blanket and at least one second element of said loop-pile fastener connected to each of said fleece panels for removably enclosing said saddle bladder and said felt pads between said saddle blanket and said fleece panels, responsive to engagement of said at least first and second elements of said loop-pile fastener.

14. An inflatable saddle support apparatus for positioning between a saddle and a horse and filling the voids between the saddle and the horse when said inflatable saddle support apparatus is inflated, said inflatable saddle support apparatus comprising an inflatable saddle bladder having sealed edges and a non-inflatable bladder seal in the center thereof; a pair of inflation chambers provided in said saddle bladder, said inflation chambers spaced by said bladder seal; a connecting inflation chamber provided in said saddle bladder adjacent to said bladder seal, said connecting inflation chamber communicating with said inflation chambers; a pair of felt pads attached to one side of said saddle bladder at said inflation chambers, respectively; a saddle blanket sized to fit over the opposite side of said saddle bladder from said felt pads; a pair of pocket means attached to said saddle blanket for removably receiving said saddle bladder and said felt pads; and an inflation tube provided in said saddle bladder at said connecting inflation chamber, said inflation tube communicating with said connecting inflation chamber, whereby air is selectively introduced into and released from said connecting inflation chamber and said inflation chambers, through said inflation tube.

15. The inflatable saddle support apparatus of claim 14 wherein said pocket means comprises a pair of felt panels, each of said felt panels having at least one edge attached to said saddle blanket and comprising first and second attachment means provided on said felt panels and said saddle blanket, respectively, said first attachment means on said felt panels engaging said second attachment means on said saddle blanket and securing said inflatable bladder and said felt pads between said felt panels and said saddle blanket.

16. The inflatable saddle support of claim 14 wherein said pocket means comprises a pair of fleece panels, each of said fleece panels having at least one edge attached to said saddle blanket and comprising at least one first element of a loop-pile fastener attached to said saddle blanket and at least one second element of said loop-pile fastener connected to each of said fleece panels for removably enclosing said saddle bladder and said felt pads between said saddle blanket and said fleece panels, responsive to engagement of said at least one first and second elements of said loop-pile fastener.

* * * * *